US009072336B2

(12) United States Patent
Borel et al.

(10) Patent No.: US 9,072,336 B2
(45) Date of Patent: Jul. 7, 2015

(54) FOOTWEAR WITH IMPROVED SOLE ASSEMBLY

(75) Inventors: René Borel, Saint-Sylvestre (FR); Frédéric Giacobone, Cusy (FR)

(73) Assignee: SALOMON S.A.S., Metz-Tessy (FR)

( * ) Notice: Subject to any disclaimer, the term of this patent is extended or adjusted under 35 U.S.C. 154(b) by 513 days.

(21) Appl. No.: 12/951,473

(22) Filed: Nov. 22, 2010

(65) Prior Publication Data

US 2011/0119956 A1 May 26, 2011

(30) Foreign Application Priority Data

Nov. 23, 2009 (FR) ..... 09 05604

(51) Int. Cl.

| | |
|---|---|
| ***A43B 9/02*** | (2006.01) |
| ***A43B 13/28*** | (2006.01) |
| ***B29D 35/00*** | (2010.01) |
| ***A43B 9/00*** | (2006.01) |
| ***A43B 9/08*** | (2006.01) |

(Continued)

(52) U.S. Cl.

CPC . *A43B 9/08* (2013.01); *A43D 25/06* (2013.01); *A43D 13/00* (2013.01); *A43B 9/02* (2013.01); *A43B 9/12* (2013.01); *A43B 23/0235* (2013.01)

(58) Field of Classification Search

CPC ..... A43B 9/02; A43B 9/06; A43B 7/125; A43B 9/08; A43B 9/12; A43B 23/0235; A43D 13/00; A43D 25/66

USPC ..... 12/142 C, 142 D, 142 E, 142 P, 142 RS, 12/142 T; 36/10, 12, 14, 17 PW, 17 R, 18, 36/21, 55, 19 R, 19 A

See application file for complete search history.

(56) References Cited

U.S. PATENT DOCUMENTS

| | | | | |
|---|---|---|---|---|
| 4,852,275 | A * | 8/1989 | Bianchini et al. | 36/102 |
| 5,768,801 | A * | 6/1998 | Huff | 36/17 R |

(Continued)

FOREIGN PATENT DOCUMENTS

| | | | |
|---|---|---|---|
| EP | 1 340 434 | A1 | 9/2003 |
| EP | 1 486 131 | A1 | 12/2004 |
| WO | WO-97/24940 | A1 | 7/1997 |

OTHER PUBLICATIONS

International Standard ISO/DIS 19952, entitled "Footwear—Vocabulary," copyright 2003, cover page and pp. 91, 92.

(Continued)

*Primary Examiner* — Clinton T Ostrup
*Assistant Examiner* — Cameron A Carter
(74) *Attorney, Agent, or Firm* — Greenblum & Bernstein, P.L.C.

(57) ABSTRACT

An article of footwear, including a sole assembly and an upper, the article of footwear extending lengthwise from a rear end to a front end, widthwise between a lateral side and a medial side, and heightwise from the outer sole assembly to an upper end, the article of footwear including a first fitting element as well as a second fitting element. The first fitting element includes a first envelope and a first sole of the strobel type, the first envelope being fixed to the first strobel sole at least with stitching. The second fitting element includes a second envelope and a second sole of the strobel type, the second envelope being fixed to the second strobel sole at least with stitching.

42 Claims, 5 Drawing Sheets

(51) Int. Cl.

| | |
|---|---|
| ***A43D 25/06*** | (2006.01) |
| ***A43D 13/00*** | (2006.01) |
| ***A43B 9/12*** | (2006.01) |
| ***A43B 23/02*** | (2006.01) |

(56) References Cited

U.S. PATENT DOCUMENTS

| | | | | |
|---|---|---|---|---|
| 6,035,555 | A * | 3/2000 | Pavelescu et al. | 36/14 |
| 6,167,640 | B1 * | 1/2001 | Schaefer | 36/98 |
| 6,226,895 | B1 * | 5/2001 | McClelland | 36/17 R |
| 6,581,305 | B2 * | 6/2003 | Ho | 36/102 |
| 6,823,609 | B2 * | 11/2004 | Moretti | 36/30 R |
| 6,862,820 | B2 | 3/2005 | Farys et al. | |
| 7,159,340 | B2 | 1/2007 | Borsoi | |
| 7,836,609 | B2 * | 11/2010 | Covatch | 36/17 R |
| 8,171,655 | B2 * | 5/2012 | Morgan | 36/18 |
| 2002/0078590 | A1 * | 6/2002 | Collins et al. | 36/3 R |
| 2002/0088145 | A1 * | 7/2002 | Clark et al. | 36/97 |
| 2003/0101620 | A1 * | 6/2003 | Reed et al. | 36/30 A |
| 2003/0163880 | A1 * | 9/2003 | Keidel et al. | 12/142 T |
| 2004/0074110 | A1 * | 4/2004 | Borsoi | 36/50.5 |
| 2004/0139629 | A1 * | 7/2004 | Wiener | 36/12 |
| 2004/0163280 | A1 * | 8/2004 | Morris et al. | 36/28 |
| 2004/0205980 | A1 * | 10/2004 | Issler | 36/19 R |
| 2004/0205982 | A1 * | 10/2004 | Challe | 36/55 |
| 2004/0250452 | A1 * | 12/2004 | Farys | 36/89 |
| 2005/0210708 | A1 * | 9/2005 | Chen | 36/55 |
| 2005/0223596 | A1 * | 10/2005 | Issler | 36/16 |
| 2005/0262728 | A1 * | 12/2005 | Robbins | 36/16 |
| 2007/0062064 | A1 * | 3/2007 | McClaskie | 36/18 |
| 2007/0204482 | A1 * | 9/2007 | Gibson-Collinson | 36/10 |
| 2008/0016717 | A1 * | 1/2008 | Ruban | 36/21 |
| 2008/0127519 | A1 * | 6/2008 | Byrne et al. | 36/102 |
| 2008/0209767 | A1 * | 9/2008 | Seamans | 36/103 |
| 2008/0216358 | A1 * | 9/2008 | Polegato Moretti | 36/3 A |
| 2008/0244934 | A1 * | 10/2008 | Covatch | 36/17 R |
| 2009/0031585 | A1 * | 2/2009 | Shepherd et al. | 36/89 |
| 2009/0044427 | A1 * | 2/2009 | Shepherd et al. | 36/89 |
| 2009/0178303 | A1 * | 7/2009 | Hurd et al. | 36/107 |
| 2009/0188131 | A1 * | 7/2009 | Doerer et al. | 36/88 |
| 2009/0277041 | A1 * | 11/2009 | Hubner | 36/12 |
| 2013/0232818 | A1 | 9/2013 | Wiener | |
| 2013/0232825 | A1 | 9/2013 | Wiener et al. | |

OTHER PUBLICATIONS

Clarks Unstructured shoe, images and cross-sectional diagrams, pp. 1-4, 2009.

* cited by examiner

Fig. 1
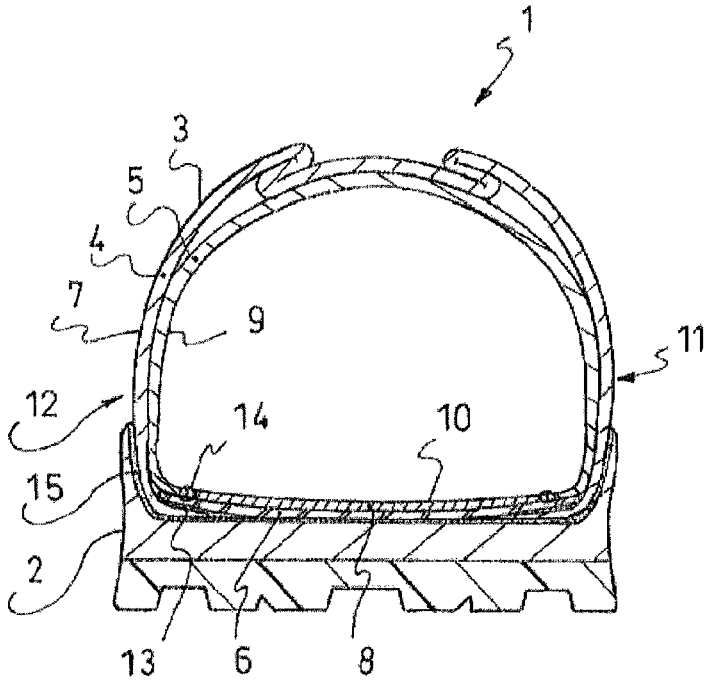
Prior Art
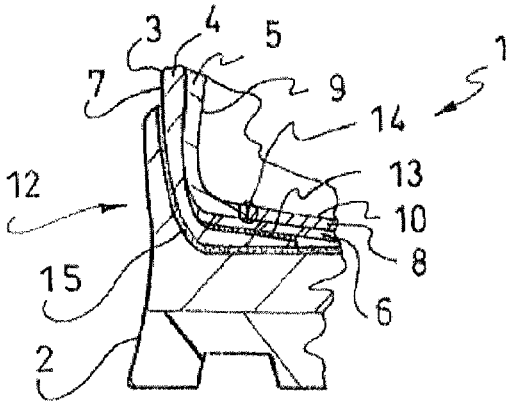
Fig. 2
Prior Art

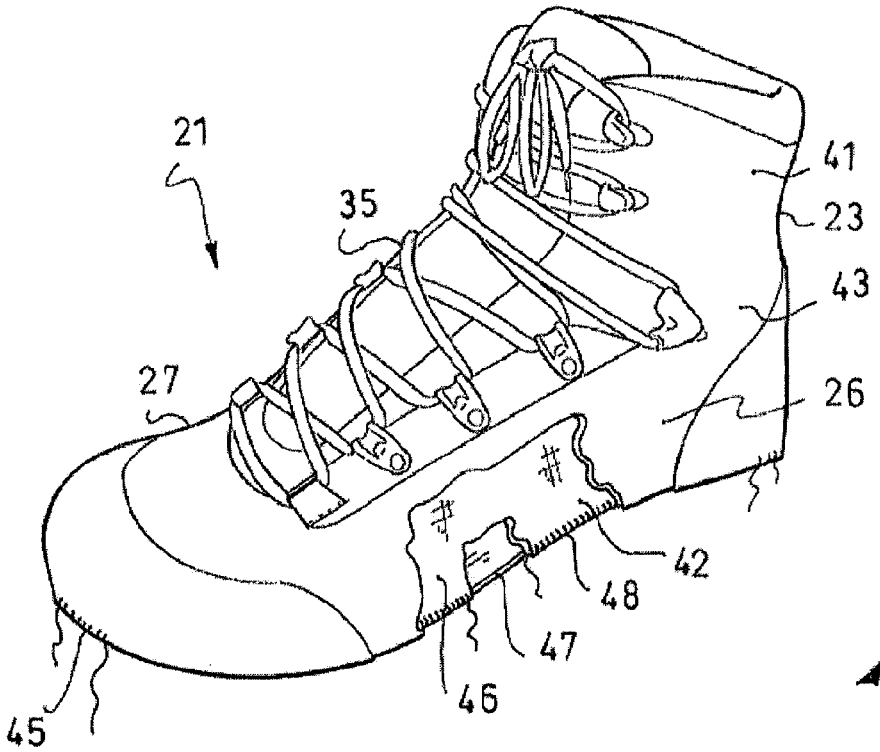
Fig. 7
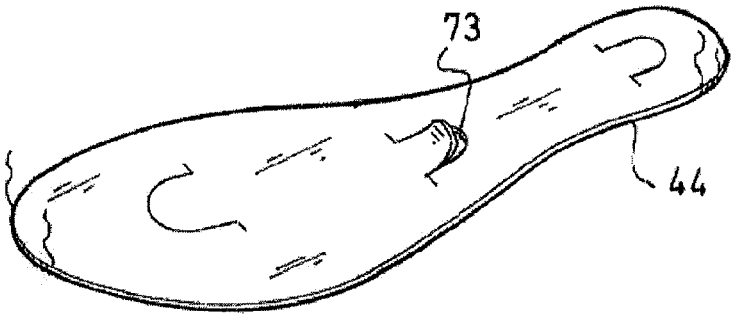
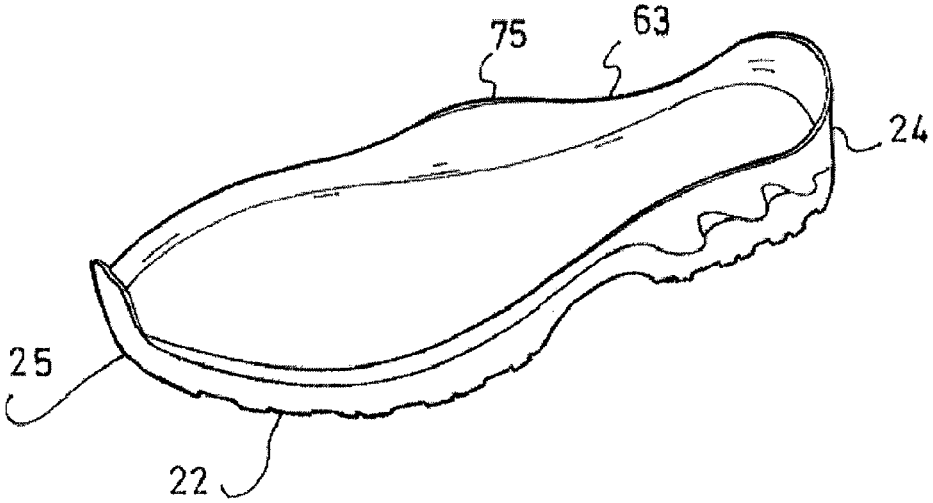

FOOTWEAR WITH IMPROVED SOLE ASSEMBLY

CROSS-REFERENCE TO RELATED APPLICATION

The instant application is based upon the French priority Patent Application No. 09.05604, filed Nov. 23, 2009, the disclosure of which is hereby incorporated by reference thereto, and the priority of which is hereby claimed under 35 U.S.C. §119.

BACKGROUND OF THE INVENTION

1. Field of the Invention

The invention relates to footwear and, particularly, footwear for any of various sports and/or for hiking. More particularly, footwear of the invention include those having a double upper, in the sense that the upper includes an outer envelope and an inner envelope. Footwear of this type can include athletic footwear for use in fields such as hiking, racing on flat or mountainous terrain, skateboarding, ball-playing sports, cross-country or telemark skiing, snowboarding, snowshoeing, and the like.

2. Background Information

For the intended use, each article of footwear, i.e., each boot or shoe (hereafter, "shoe" for convenience), must have a certain flexibility and a good damping capability. Flexibility must be understood as the ability to closely follow certain deformations of the foot. This involves, for example, enabling good foot rolling movement when walking. Damping serves to reduce, or even prevent, fatigue or injuries that can result from supports or impacts on the ground, or from various forces.

A shoe must also fulfill a variety of functions, sometimes contradictory, such as ensuring adequate support and/or tightening of the foot, while also providing it with satisfactory comfort.

Thus, it is known to manufacture shoes as shown in FIGS. 1 and 2. These two figures illustrate, in total and partial transverse cross section, respectively, an outer sole assembly 2 and an upper 3. The upper includes a first envelope 4 and a second envelope 5, both being adapted to cover the foot directly or indirectly. The first envelope 4 is associated with a first lasting sole 6 to form a first fitting element 7. The second envelope 5 is associated with a second lasting sole 8 to form a second fitting element 9, the latter being mounted inside the first fitting element 7. The second fitting element 9 is typically a slipper, i.e., a liner. Consequently, the lasting soles 6, 8 are part of an inner sole assembly 10. The first envelope 4 of the shoe 1 extends in the area of a lateral side 11 and a medial side 12, as well as in the area of a substantial portion of the first lasting sole 6. This structure is conventional, because the first envelope 4 is mounted upon the lasting sole 6 by means of an adhesive, or cement, layer 13. The sole 6 is relatively rigid in order to withstand the assembly process, also referred to as the lasting process. The adhesive process is carried by pulling the envelope 4 so as to press it flat upon the sole 6, a last being inserted in the fitting element 7. This is referred to as the conventional lasting. This makes it possible to exert sufficient pressure while the adhesive is being heated in order to obtain the first fitting element 7. The second fitting element 9 is obtained, for example, by affixing the second envelope 5 to the second lasting sole 8 using stitching 14. This is referred to as strobel lasting. The sole 8, which is flexible and can be stitched, is called the strobel sole. Alternatively, a molded, unitary structure, or any equivalent, could be provided.

It is to be understood that the first fitting element 7 is adapted to ensure support and tightening of the foot, while the second fitting element 9 fulfills other functions, such as providing a certain comfort. In addition, the first fitting element 7 is affixed to the outer sole assembly 2 via an adhesive layer 15. In the end, the shoe 1 according to FIGS. 1 and 2 has a certain flexibility and a certain damping capability.

Generally speaking, flexible shoes provided with two fitting elements according to the prior art have the following disadvantage: they still hinder the foot rolling movement, at least partially, due to the rigid lasting board, especially for racing; and the transmission of supports, impacts, and other forces is overly intense. In other words, known shoes lack flexibility, and their damping capability is insufficient, because the folded portion of the envelope 4, associated with the adhesive layer 13, creates an extra thickness that increases the rigidity of the shoe.

Another disadvantage is that of thermal insulation. Indeed, under difficult conditions of use, such as walking in snow, the user's feet can become cold. This is due to the formation of a thermal bridge at the junction between the upper and the outer sole assembly, such bridge being created by the crushing of the material during the conventional lasting operation. Indeed, during this operation, it is necessary to heat and pull very hard on the constituent materials of the envelope 4.

Another disadvantage is that of the conventional lasting, rendering the manufacturing process difficult. Indeed, adhesively positioning of an envelope on a lasting sole is a relatively difficult process. Powerful and precise machines are necessary for pulling, positioning, and gluing the envelope.

Another disadvantage inherent in certain known flexible shoes, is the poor positional stability of the second fitting element in the first. For example, removing the foot sometimes causes an undesired displacement of the second element with respect to the first.

SUMMARY

In view of the preceding, the invention provides an improved article of footwear, such as a shoe or a boot. In particular, the invention facilitates the rolling movement of the foot in an article of footwear provided with a plurality of fitting elements, and improves its damping capability.

The invention also guarantees the positional stability of one fitting element with respect to the other.

The invention also provide a good thermal insulation, in particular at the junction between the upper and the outer sole assembly.

The invention also simplifies the shoe manufacturing process, and lowers the production costs.

To this end, the invention is directed to an article of footwear that includes a sole assembly and an upper, the article of footwear extending lengthwise from a rear end to a front end, widthwise between a lateral side and a medial side, and heightwise from the sole assembly up to an upper end, the article of footwear including a first fitting element as well as a second fitting element.

The first fitting element of the article of footwear according to the invention furthermore includes a first envelope and a first sole of the strobel type, the first envelope being affixed to the first strobel sole at least by means of stitching, and the second fitting element includes a second envelope and a second sole of the strobel type, the second envelope being fixed to the second strobel sole by means of at least stitching.

Using stitching to affix an envelope and a strobel sole preserves the structure of these elements. This means in particular that the envelopes and the strobel soles are not, or are only slightly, stretched, compressed, or modified overall during manufacture. Thus, for example, the thickness of an envelope or of a strobel sole remains uniform, or substantially uniform, along its entire surface. Also, the stitching technique involves using a sole of the strobel type, which is more flexible than it would be with the adhesive technique. Indeed, in this latter case, a lasting sole is structured to withstand the pressures from applying and adhering the envelope on the sole, as well as keeps the envelope in place after the adhesion. These constraints are inexistent in the footwear of the invention, which provides greater flexibility to the lower portion of the upper and/or the sole assembly than in an article of footwear according to the prior art. The strobel soles, which can be stitched, are made out of flexible and/or damping materials. Consequently, the greater flexibility of the shoe of the invention enables a better dissipation of the energy related to impulses, impacts, and various forces.

The resulting advantages include better foot rolling movement and, overall, better damping.

A good positional stability of the second fitting element in the first is also noted. Indeed, the stitching technique makes it possible to use precise patterns, thus providing the fitting elements with precise configurations. Therefore, it is easy to provide an adjustment without play and constraint of the second element in the first. One of the resulting advantages is a better foot support in the upper.

The article of footwear according to the invention has a better thermal insulation, in particular at the junction between the upper and the outer sole assembly. This results from preserving the constituent materials of the envelopes and/or of the strobel soles. This preservation results from using the stitching technique. It is not necessary to stretch or heat the materials. The technique of the invention simplifies and lowers the cost of the manufacturing process for the article of footwear.

BRIEF DESCRIPTION OF DRAWING

Other characteristics and advantages of the invention will be better understood from the description that follows, with reference to the annexed drawings illustrating, by way of non-limiting embodiments, how the invention can be embodied, and in which:

FIG. 1 is a transverse cross-section of a shoe according to the prior art;

FIG. 2 is a partial enlargement of FIG. 1;

FIG. 7 is a perspective exploded view of the article of footwear according to FIG. 3.

DETAILED DESCRIPTION

The first embodiment, which is described hereinafter, relates by way of example to articles of footwear, such as boots or shoes, for walking or hiking on hard ground or in snow, or with regard to other surfaces. The invention relates to footwear particularly for use in other fields of endeavor and for various purposes, such as those mentioned above. Although reference to shoes and boots is made herein, such terms are not to be construed as a limitation on the types of footwear that are encompassed by the invention. As one example, footwear having various types of uppers are embraced by the invention, such as footwear having low uppers, high uppers, and mid-uppers.

A first embodiment is described hereinafter with reference to FIGS. 3 to 7.

Figure 3:
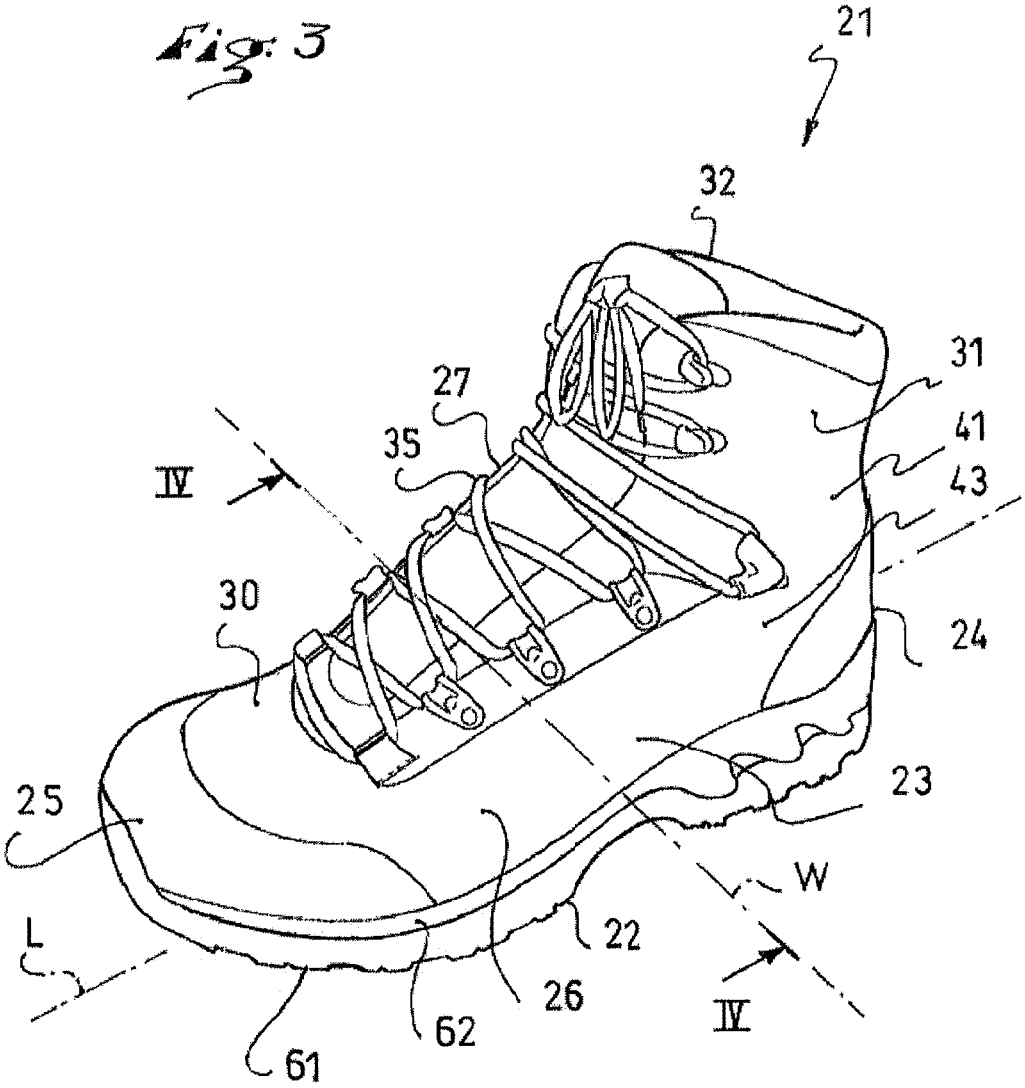
FIG. 3 is a perspective front view of an article of footwear, top side, according to a first embodiment of the invention.

As shown in FIG. 3, a hiking boot 21 is adapted to receive the foot of a wearer. In a known fashion, the boot 21 includes an outer sole assembly 22 and an upper 23 arranged on the sole assembly. The boot extends lengthwise, along a longitudinal direction L, between a rear end, or heel 24, and a front end, or tip 25; and widthwise, along a transverse direction W, between a lateral side 26 and a medial side 27.

As shown, the upper 23 includes a lower portion 30, adapted to surround the foot, as well as an upper portion 31, adapted to surround the ankle and possibly the lower leg. However, as described below, the invention also encompasses footwear having only the low portion, i.e., an article of footwear, or shoe, having a low upper, i.e., an upper having an upper edge that extends below the ankle of the wearer. In addition, the invention encompasses footwear having a mid-upper, i.e., an upper having an upper edge that extends at the ankle, or substantially at the ankle.

According to the first illustrated embodiment, the boot 21 extends heightwise from the outer sole assembly 22 to an upper end 32, or collar, i.e., up to the free end of the upper portion 31 of the boot or of the upper 23.

The boot 21 is structured to allow good foot rolling movement when walking, transmissions of sensory information and impulse forces for supports or jump landings. For this reason, the outer sole assembly 22 and the upper 23 are relatively flexible.

The boot 21 further includes a first tightening device 35, adapted to reversibly tighten the upper 23, i.e., selectively both to tighten the upper and to loosen the forces of the upper relative to the foot therewithin. The tightening device 35 is not described further here as it is well-known to the one of ordinary skill in the art. It is however noted, still within the scope of the invention, that the boot 21 can be provided with a different tightening device or not to include a tightening device. In the latter case, the upper 23 is continuous from the lateral side 26 to the medial side 27.

Figure 4:
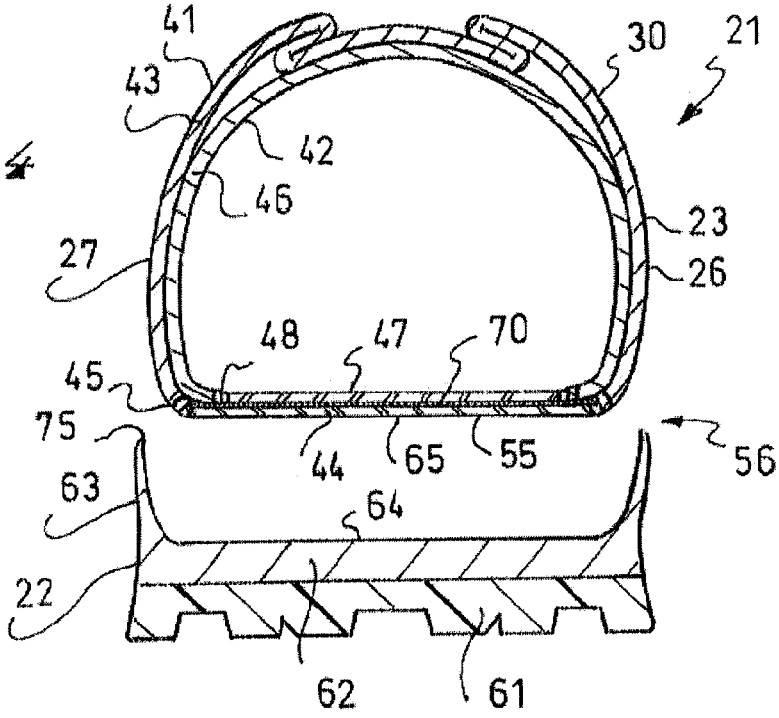
FIG. 4 is a transverse cross section along the line IV-IV of FIG. 3, prior to the fitting elements being affixed to the outer sole assembly.
Figure 6:
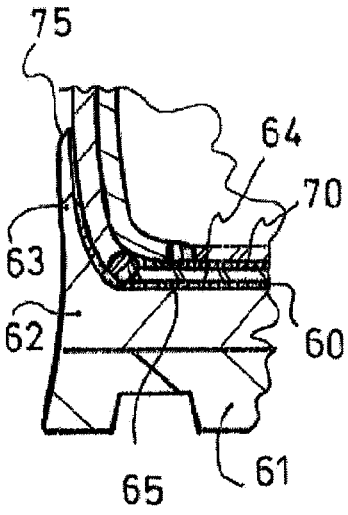
FIG. 6 is a partial enlargement of FIG. 5.
Figure 5:
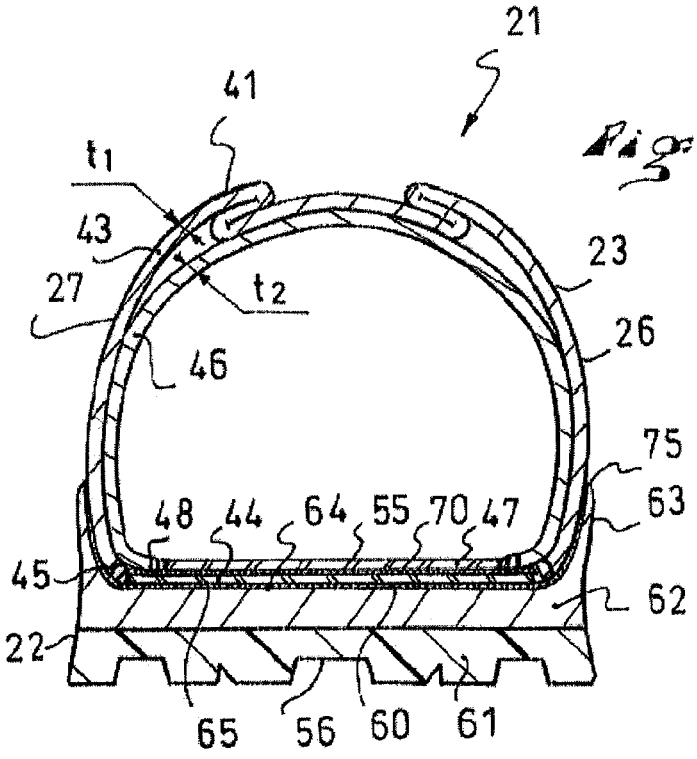
FIG. 5 is a transverse cross section, similar to FIG. 4, with the fitting elements affixed to the outer sole assembly.

As can be understood from FIGS. 4 to 6, in particular, the boot 21 includes a first fitting element 41, as well as a second fitting element 42. Explained further below, the first fitting element 41 is an external element, directly exposed to possible contact with objects and obstacles. The first tightening device 35 is in fact arranged on the first fitting element 41. The second fitting element 42 is an internal element, adapted to be inserted within the first element 41.

According to the invention, the first fitting element 41 includes a first envelope 43 and a first sole 44 of the strobel type, the first envelope 43, in an edge area, that is, an area of the bottom extremity, being fixed to the first strobel sole 44 by an arrangement, or connection, that includes stitching 45 extending along the periphery of the first strobel sole. The second fitting element 42 includes a second envelope 46 and a second sole 47 of the strobel type, the second envelope 46, in an edge area, that is, an area of the bottom extremity, being fixed to the second strobel sole 47 by an arrangement, or connection, that includes stitching 48 extending along the periphery of the second strobel sole.

With respect to the terms employed, a rigorous respect for tradition requires reference to first and second strobel soles 44, 47, designated as such because they are adapted to be sewn to the envelopes 43, 46, respectively. For convenience of this description, reference will be simply made to the first strobel 44 and the second strobel 47.

The stitching 45 between the first envelope 43 and the first strobel 44 provides the first fitting element 41 with great flexibility. This means that the flexibility of the first element 41 is greater than it would be with the conventional adhesive lasting technique. The second fitting element 42 is also very flexible, because it is also constructed using a technique other than the adhesive lasting technique. Consequently, the shoe 21 has great flexibility, in particular in the area of the junction between the upper 23 and the outer sole assembly 22. As a result, foot rolling movement when walking or running is facilitated.

The aforementioned advantage is obtained with envelopes 43, 46 having a generally known structure. In this regard, the first envelope 43, although illustratively simplified, includes one or more layers, that is, a plurality of layers, depending upon the application. For example, the first envelope 43 includes an outer layer, a core, an inner layer, and an inner lining. Similarly, the second envelope 46 includes one or more layers. For example, the second envelope 46 includes an insulating foam layer, or a waterproof membrane, or a combination of both. Stitching if made on a waterproof membrane, can be covered by a substance or a strip adapted to block the holes made during the stitching. Consequently, the upper 23 includes at least two envelopes 43, 46 having different mechanical and physical properties.

The boot 21 includes an inner sole assembly 55, which includes the first strobel 44 and second strobel 47. The inner sole assembly 55 can be provided to further include an insole, not shown. Such further insole would be in contact with the foot, inasmuch as it would be positioned within the second fitting element 42.

Taking into account all of the components, the shoe 21 includes a complete sole assembly 56 comprised of the outer sole assembly 22 and the inner sole assembly 55. Given that the first fitting element 41 calls for the stitching technique, the first strobel 44 selected is very flexible with respect to the lasting sole used in the conventional adhesive lasting. This flexibility enables a stitch to be made. This is the reason why the complete sole assembly 56 according to the invention is more flexible than a complete sole assembly according to the prior art.

By way of example, and in a non-limiting manner, the flexibility of the first strobel 44 is substantially equal to the flexibility of the second strobel 47. This means that the flexibility of the first strobel 44 is equal to more or less than 50% of the flexibility of the second strobel. It could also be said that the rigidity of the first strobel 44 is equal to more or less than 50% of the rigidity of the second strobel 47, even if these rigidities are low. In comparison with the prior art, with respect to adhesive lasting, the rigidity of the first lasting sole is equal to or greater than 150% of the rigidity of the strobel sole of the second fitting element.

To construct the shoe 21 according to the first embodiment, with reference to embodiment illustrated in FIGS. 4 to 7, the stitching 45, which affixes the first envelope 43 to the first strobel 44, extends over the entire junction between the envelope 43 and the first strobel 44. In other words, the stitching 45 makes a complete turn about the first strobel 44. This provides the first fitting element 41 with maximum flexibility. Alternatively, partial stitching could be provided, as well as an adhesive where stitching is not employed. In such a case, certain portions of the element 41 are more flexible than others.

According to the same principle, the stitching 48, which affixes the second envelope 46 to the second strobel 47, extends over the entire junction between the envelope 46 and the second strobel 47. The stitching 48 makes a complete turn about the second strobel 47. Thus, the flexibility of the second fitting element 42 is maximum. Alternatively, partial stitching could be provided.

To obtain a completely assembled shoe 21, the upper 23 is required to be affixed to the outer sole assembly 22. More precisely, the first fitting element 41 is adhesively affixed to the outer sole assembly 22, using an adhesive layer 60, or cement.

Although not limiting to the invention, the outer sole assembly 22 includes a plurality of layers, such as, for example, an outsole 61, or external sole, adapted to contact the ground, as well as a damping midsole 62, inserted between the outsole 61 and the first fitting element 41. In a known fashion, the outsole 61 includes rubber, or any abrasion-resistant material. The damping midsole 62 includes an absorbing material, such as foam made of ethyl vinyl acetate (EVA) or any equivalent. The outer sole assembly 22 can include a single layer or, on the contrary, more layers, such as three or more layers.

According to the first embodiment, the outer sole assembly 22 has a lip 63, in the area of the junction with the first fitting element 41, to increase the surface of contact with the fitting element 41. In this case, the lip 63 originates from the damping midsole 62. The lip 63 is continuous and follows the contour of the outer sole assembly 22. Alternatively, a sectioned or discontinuous lip could be provided. A continuous lip increases the usable surface for affixing the sole assembly 22 to the first fitting element 41. Consequently, the adhesive layer 60 extends along the lip 63 and on the top 64 of the outer sole assembly 22. This adhesive layer 60 extends in the area of the lower portion 65 of the first strobel 44, and in the area of the base of the first envelope 43.

According to the first embodiment of the invention, the second fitting element 42 is affixed to the first fitting element 41 by a means shown in the form of cement or adhesive layer 70. More precisely, the second strobel 47 is affixed to the first strobel 44 by means of cement/adhesive. Alternatively, other structures, such as a pair of fabrics having respective hook and loop fastening elements (such as Velcro®), could be provided. As shown in FIG. 7, the first strobel 44 has passages 73 (three being exemplarily illustrated), adapted to promote the application of the adhesive constituting the two layers 60, 70, that is, they are adhesive-receiving passages. These passages 73 are temporary, being created via partial cutouts, i.e., slits, in the strobel sole 44, which is otherwise generally continuous within its periphery, as shown. However, permanent passages, obtained by complete cutouts, could alternatively be provided for adhesive. As another alternative, an adhesive could be injected via hollow needles, or using a thermoplastic adhesive. The adhesive/cement 70 enables a permanent retention of the fitting elements with respect to one another. "Permanent retention," in this context, means that the fitting elements 41 and 42, i.e., first and second strobel soles 44, 47, once adhesively joined, would not retain their integrity, or at least not easily retain their integrity, by attempts to undo the adhesive joining.

A method of manufacturing the boot 21 can be summarized as follows. Such a method involves making a first fitting element 41, which includes a first envelope 43 and a first strobel sole 44 assembled to one another by stitching; making a second fitting element 42, which includes a second envelope 46 and a second strobel sole 47 assembled to one another by stitching; making an outer sole assembly 22; adhesively affixing the second fitting element 42 to the first fitting element 41; and affixing the outer sole assembly 22 to the first fitting element 41, so that the thickness t1 of the first envelope 43 and/or the thickness t2 of the second envelope 46 (see FIG. 5, e.g.), in the area of the junction with the sole assembly 22, is between 50% and 100% of the value it has away from this junction, i.e., spaced from the junction.

In fact, the thickness t1 of the first envelope 43 is substantially constant, or uniform, in particular along the lateral side 26 and/or the medial side 27. Particularly near the junction between the first envelope 43 and the first lasting sole 44, as well as in the area of this junction itself, the thickness t1 is substantially constant. In other words, the thickness t1 is substantially constant in the vicinity and area of the peripheral lip 63 of the outer sole assembly 22. This is because the pressure from gluing the first fitting element 41 on the sole assembly 22 is low. The constituent materials of the envelope 43 and of the first sole 44 are preserved, in the sense that their structure remains the same everywhere. In particular, this structure is not irreversibly crushed. Moreover, in the invention, the envelope is not tensionally stressed in order to be applied on a lasting sole.

The thickness t1 of the first envelope 43, measured in the area of the stitching 45, ranges between 90% and 100% of this same thickness t1 when measured in the area of the top 75 of the lip 63. Such a small variation in thickness is found in particular in a snow boot, which is a boot having no device for tightening the upper, i.e., a boot whose upper is continuous from one side 26, 27 to the other. In the area of the stitching 45, in different respective embodiments, the thickness t1 can range between 50% and 100% of this same thickness t1 in the area of the top 75 of the lip 63. This variation, still small compared to that observed in a conventional shoe assembled by gluing the envelope on the lasting sole, is noted in shoes that are more adapted to walking or running on harder surfaces. In any case, preserving all the thickness t1, or at least a substantial portion of the thickness t1, improves thermal insulation. Such insulation is preserved in the area of the junction between the envelope 43 and the outer sole assembly 22. There is no obstructing thermal bridge, and comfort with the foot within the boot 21 is greater, especially in snow.

The preceding also applies to the second fitting element 42. The thickness t2 of the second envelope 46 is substantially constant, or uniform, in particular along the lateral side 26 and/or the medial side 27. The thickness t2 is substantially constant in the vicinity of the junction between the second envelope 46 and the second strobel 47, as well as in the area of this junction. The thickness t2 is substantially constant in the vicinity and area of the peripheral lip 63 of the outer sole assembly 22. Here again, the pressure from gluing the second fitting element 42 in the first element 41 is low, even very low. The constituent materials of the envelope 46 and of the second sole 47 are preserved, their structure remaining the same everywhere.

The thickness t2 of the second envelope 46, measured in the area of the stitching 48, ranges between 90% and 100% of this same thickness t2 when measured in the area of the top 75 of the lip 63. Here again, in the area of the stitching 48 the thickness t2, in different respective embodiments, the thickness t2 can range between 50% and 100% of the thickness t2 in the area of the top 75 of the lip 63.

For certain applications, the second envelope 46 is provided to include a waterproof layer or membrane, and the second strobel 47 is also provided to include a waterproof layer or membrane. Thus, in this case, the second fitting element 42 is a slipper, or sockliner, which is impervious or very resistant to water penetration. It is advantageous to cover the stitching 48 with a waterproof strip of material glued to both the second envelope 46 and the sole 47. Such a strip renders the stitching 48 impervious by blocking the passage holes for the threads of the stitching. Waterproofness can be obtained by other means, such as a direct application of a covering material, or the positioning of a waterproof extra sole.

Figure 8:
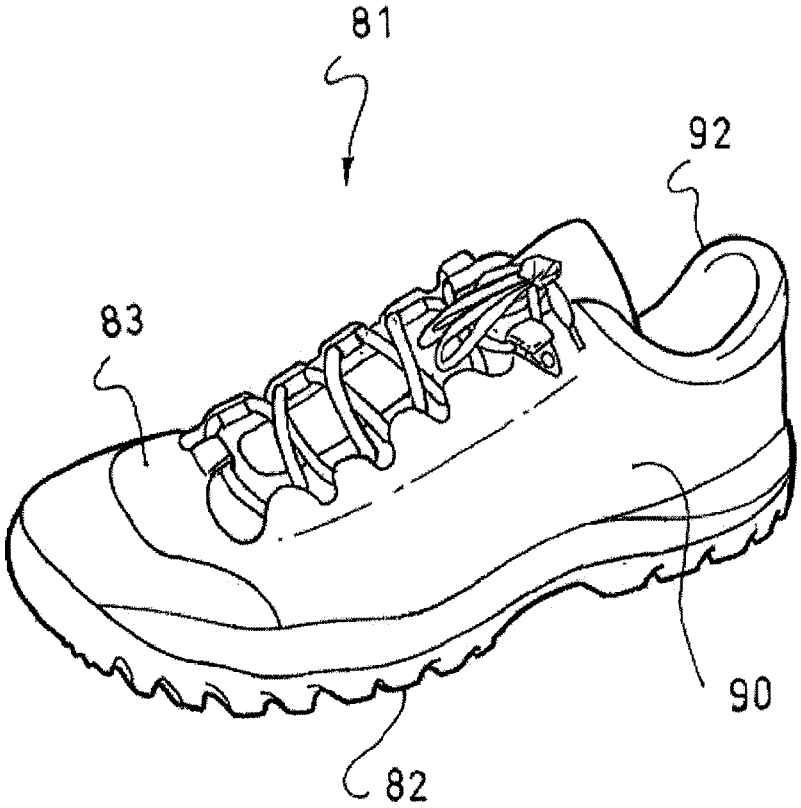
FIG. 8 is a perspective front view of an article of footwear according to a second embodiment of the invention.

A second embodiment of the invention is summarily shown in FIG. 8. Only the differences with respect to the first embodiment are shown.

According to this second embodiment, a shoe 81 includes an outer sole assembly 82 and an upper 83. What is specific to this shoe 81 is that the upper 83 is a low upper, in the sense that it includes a lower portion 90, excluding any upper portion. In other words, the upper end 92, or collar, of the lower portion 90 is below the area of the ankle when the shoe 81 is worn. The shoe 81 is consequently well-adapted for walking or running.

The article of footwear according to the invention can be made from materials and according to implementation techniques and methods known to those of ordinary skill in the art of footwear and footwear manufacturing.

The invention is not limited to the particular embodiments herein described and illustrated, and includes all of the technical equivalents that fall within the scope of the claims that follow.

In particular, one can provide to add one or more fitting elements. Thus, the shoe can include a third fitting element.

One can also provide to leave a free space between two fitting elements. This space could be naturally filled with air, and used as a heat insulator. Alternatively, the space can be filled with other insulating materials.

In addition, the invention illustratively disclosed herein suitably may be practiced in the absence of any element which is not specifically disclosed herein.

The invention claimed is:

1. An article of footwear comprising:

a length extending from a rear end to a front end;

a width extending between a lateral side and a medial side;

a height extending from a bottom of an outer sole assembly to an upper end of an upper;

the outer sole assembly;

the upper comprising a first envelope and a second envelope;

an inner sole assembly comprising a first strobel sole and a second strobel sole;

a first fitting element comprising:

the first envelope of the upper;

the first strobel sole of the inner sole assembly;

a first stitching extending through the first strobel sole and an edge area of the first envelope to affix together the first strobel sole and the first envelope;

a second fitting element positioned within the first fitting element, the second fitting element comprising:

the second envelope of the upper;

the second strobel sole of the inner sole assembly;

a second stitching extending through the second strobel sole and an edge area of the second envelope to affix together the second strobel sole and the second envelope;

the first strobel sole comprising:

a front end, a medial side, a rear end, and a lateral side;

a periphery extending through the front end, the medial side, the rear end, and the lateral side;

the second strobel sole comprising:

a front end, a medial side, a rear end, and a lateral side;

a periphery extending through the front end, the medial side, the rear end, and the lateral side.

2. An article of footwear according to claim 1, wherein:

the first stitching extends over an entirety of a junction between the first envelope and the first strobel sole.

3. An article of footwear according to claim 1, wherein:

the second stitching extends over an entirety of a junction between the second envelope and the second sole.

4. An article of footwear according to claim 1, wherein:

the first envelope has a thickness substantially constant in an area of a junction between the first envelope and the first strobel sole.

5. An article of footwear according to claim 1, wherein:

the second envelope has a thickness substantially constant in an area of a junction between the second envelope and the second strobel sole.

6. An article of footwear according to claim 1, wherein:

the first strobel sole has a flexibility substantially equal to a flexibility of the second strobel sole.

7. An article of footwear according to claim 1, wherein:

the second envelope includes a waterproof layer;

the second strobel sole includes a waterproof layer.

8. An article of footwear according to claim 1, wherein:

an adhesive affixes the second strobel sole to the first strobel sole.

9. An article of footwear according to claim 1, wherein:

an adhesive affixes the first fitting element to the outer sole assembly.

10. A method of manufacturing an article of footwear, said method comprising:

making a first fitting element to include a first envelope, having a first thickness and a first strobel sole, said making comprising assembling the first envelope to the first strobel sole to have a strobel construction by stitching an edge area of the first envelope to the first strobel sole;

making a second fitting element to include a second envelope, having a second thickness, and a second strobel sole, said making a second fitting element comprising assembling the second envelope to the second strobel sole to have a strobel construction by stitching an edge area of the second envelope to the second strobel sole;

making an outer sole assembly;

affixing the second fitting element to the first fitting element and affixing the outer sole assembly to the first fitting element comprises at least one of the following:

the first thickness of the first envelope, in an area of a junction with the outer sole assembly, ranges between 50% and 100% of a thickness away from said junction;

the second thickness of the second envelope, in an area of a junction with the outer sole assembly, ranges between 50% and 100% of a thickness away from said junction;

said affixing the second fitting element to the first fitting element comprising placing the second fitting element within the first fitting element and applying a permanent connection for permanent retention of the second fitting element in relation to the first fitting element.

11. A method according to claim 10, wherein:

said making of the first fitting element does not include heating of the first envelope or heating of the first strobel sole;

said making of the second fitting element does not include heating of the second envelope or heating of the second strobel sole.

12. A method according to claim 10, wherein:

said making of the first fitting element does not include stretching of the first envelope or stretching of the first strobel sole;

said making of the second fitting element does not include stretching of the second envelope or stretching of the second strobel sole.

13. An article of footwear according to claim 1, wherein:

the first envelope includes a medial side and a lateral side;

the first stitching affixes the first strobel sole at least to the medial and lateral sides of the first envelope.

14. An article of footwear according to claim 1, wherein:

the second envelope includes a medial side and a lateral side;

the second stitching affixes the second strobel sole at least to the medial and lateral sides of the second envelope.

15. An article of footwear according to claim 13, wherein:

the second envelope includes a medial side and a lateral side;

the second stitching affixes the second strobel sole at least to the medial and lateral sides of the second envelope.

16. An article of footwear according to claim 1, wherein:

the first stitching connecting only the first envelope and the first strobel sole together.

17. An article of footwear according to claim 1, wherein:

the second stitching connecting only the second envelope and the first strobel sole together.

18. An article of footwear according to claim 1, wherein:

the first and second strobel soles form part of an inner sole assembly of the article of footwear.

19. An article of footwear according to claim 1, wherein:

the second fitting element is contained within and lines the first fitting element;

each of the first and second fitting elements has a respective strobel construction.

20. An article of footwear according to claim 19, wherein:

the second strobel sole is affixed to the first strobel sole.

21. An article of footwear according to claim 8, wherein:

an adhesive affixes the first fitting element to the outer sole assembly.

22. An article of footwear according to claim 9, wherein:

the outer sole assembly comprises a plurality of layers;

one of the plurality of layers comprises a midsole; and an adhesive affixes the first fitting element to the midsole.

23. An article of footwear according to claim 22, wherein:

the midsole comprises a damping midsole.

24. An article of footwear according to claim 1, wherein:

the first stitching extends around an entirety of the periphery of the first strobel sole; and the second stitching extends around an entirety of the periphery of the second strobel sole.

25. An article of footwear according to claim 1, wherein:

the first stitching extends partially around an entirety of the periphery of the first strobel sole; and the second stitching extends partially around an entirety of the periphery of the second strobel sole.

26. An article of footwear according to claim 1, wherein:

at least one of the first strobel sole and the second strobel sole comprises a damping material.

27. An article of footwear according to claim 1, wherein:

each of the first strobel sole and the second strobel sole is a flexible sole designed to facilitate stitching.

28. An article of footwear according to claim 1, wherein:
each of the first envelope and the second envelope comprises a plurality of layers.

29. An article of footwear according to claim 28, wherein:
the plurality of layers of the second envelope comprises an insulating foam layer or a waterproof layer or both an insulating foam layer and a waterproof layer.

30. An article of footwear according to claim 2, wherein:
the outer sole assembly comprises a damping layer; and
a sealing lip extends upwardly from the damping layer and from the junction between the first envelope and the first strobel sole.

31. An article of footwear according to claim 30, wherein:
an adhesive is positioned between the sealing lip and the first envelope.

32. An article of footwear according to claim 1, wherein:
the first strobel sole comprises adhesive-receiving through-passages in the first strobel sole.

33. An article of footwear according to claim 32, wherein:
a first adhesive layer secures together the first strobel sole and the second strobel sole; and
a second adhesive layer secures together the first strobel sole and the outer sole assembly.

34. An article of footwear according to claim 1, wherein:
the first strobel sole comprises a plurality of slits and, except for the slits, the first strobel is generally continuous within the periphery of the first strobel sole.

35. An article of footwear according to claim 1, wherein:
the upper comprises:
a lower portion designed to extend over a foot of a wearer; and
an upper portion designed to extend over an ankle of the wearer.

36. An article of footwear according to claim 1, wherein:
the first envelope has a thickness in an area of a junction between the first envelope and the first strobel sole substantially equal to a thickness in an area spaced upwardly away from the junction; and
the second envelope has a thickness in an area of a junction between the second envelope and the second strobel sole substantially equal to a thickness in an area spaced upwardly away from the junction.

37. An article of footwear according to claim 1, wherein:
the first envelope has mechanical and physical properties different from mechanical and physical properties of the second envelope.

38. An article of footwear according to claim 37, wherein:
the first strobel sole has a flexibility substantially equal to a flexibility of the second strobel sole.

39. A method according to claim 10, wherein:
said making of the first fitting element includes neither stretching of the first envelope nor stretching of the first strobel sole; and
said making of the second fitting element includes neither stretching of the second envelope nor stretching of the second strobel sole.

40. A method according to claim 10, wherein:
said making of the first fitting element includes neither a permanent compression of the thickness of the first envelope nor a permanent compression of the thickness of the first strobel sole; and
said making of the second fitting element includes neither a permanent compression of the thickness of the second envelope nor a permanent compression of the thickness of the second strobel sole.

41. A method of manufacturing an article of footwear having an upper and an outer sole assembly, said method comprising:
constructing an inner fitting element of the upper, the inner fitting element designed to extend around a wearer's foot, the fitting element comprising an inner envelope designed to extend over the wearer's foot and an inner strobel sole designed to extend under the wearer's foot;
said constructing an inner fitting element comprising stitching together and through respective edge regions of the inner envelope and the inner strobel sole so that the inner fitting element has a strobel construction;
constructing an outer fitting element of the upper, the outer fitting element designed to extend around the wearer's foot and around the inner fitting element, the outer the fitting element comprising an outer envelope designed to extend over the wearer's foot and an outer strobel sole designed to extend under the wearer's foot;
said constructing an outer fitting element comprising stitching together and through respective edge regions of the outer envelope and the outer strobel sole so that the outer fitting element has a strobel construction;
affixing the inner fitting element within the outer fitting element to prevent the inner fitting element to be moved out of the outer fitting element; and
affixing the outer sole assembly in relation to the outer fitting element.

42. A method according to claim 41, wherein:
the affixing the inner fitting element within the outer fitting element comprises adhesively affixing the inner fitting element within the outer fitting element.

* * * * *